US011827420B2

(12) United States Patent
Shin

(10) Patent No.: US 11,827,420 B2
(45) Date of Patent: Nov. 28, 2023

(54) SILICONE ZIPPER BAG

(71) Applicant: SHINSUNG SILICONE CO., LTD., Seoul (KR)

(72) Inventor: Ye Hyun Shin, Siheung-si (KR)

(73) Assignee: SHINSUNG SILICONE CO., LTD., Seoul (KR)

( * ) Notice: Subject to any disclaimer, the term of this patent is extended or adjusted under 35 U.S.C. 154(b) by 0 days.

(21) Appl. No.: 17/711,683

(22) Filed: Apr. 1, 2022

(65) Prior Publication Data

US 2022/0306346 A1 Sep. 29, 2022

Related U.S. Application Data

(63) Continuation of application No. PCT/KR2022/002433, filed on Feb. 18, 2022.

(30) Foreign Application Priority Data

Mar. 25, 2021 (KR) ..... 10-2021-0038551

(51) Int. Cl.
*B65D 33/25* (2006.01)
*B65D 33/06* (2006.01)

(52) U.S. Cl.
CPC ..... *B65D 33/2508* (2013.01); *B65D 33/065* (2013.01)

(58) Field of Classification Search
CPC ..... B65D 33/2508; B65D 33/065
USPC ..... 383/7
See application file for complete search history.

(56) References Cited

U.S. PATENT DOCUMENTS 3,478,952 A * 11/1969 Perlman ..... B65D 33/22 206/521
5,238,306 A * 8/1993 Heintz ..... B65D 33/2541 493/962
5,852,830 A * 12/1998 Horn ..... A47K 11/12 383/41
5,908,245 A * 6/1999 Bost ..... B65D 33/007 383/65

(Continued)

FOREIGN PATENT DOCUMENTS

JP H07-88940 A 4/1995
JP 2004-26193 A 1/2004

(Continued)

OTHER PUBLICATIONS

Office Action issued in KR 10-2021-0038551; mailed by the Korean Intellectual Property Office dated Jun. 9, 2021.

*Primary Examiner* — Peter N Helvey
(74) *Attorney, Agent, or Firm* — Studebaker & Brackett PC

(57) ABSTRACT

The present disclosure relates to a silicone zipper bag, and more particularly, to an improved silicone zipper bag with excellent sealing properties with a triple sealing structure. Among other things, the present disclosure relates to an improved silicone zipper bag that not only continuously maintains safe and close sealing properties by increasing the effect of suppressing the opening of the central portion according to pressure distribution by adopting a curved sealing structure, but also fundamentally prevents defects in air bubbles or foreign matter (dirt) from being caught in and tearing an adhered area because two sheets are not laminated together but molded simultaneously to make one piece.

2 Claims, 8 Drawing Sheets

(56) References Cited

U.S. PATENT DOCUMENTS

| | | | | |
|---|---|---|---|---|
| 6,345,911 | B1 * | 2/2002 | Young | B65D 33/10 383/44 |
| 7,574,780 | B2 * | 8/2009 | Meager | A44B 19/32 24/399 |
| 9,938,047 | B2 * | 4/2018 | Batarseh | B65D 33/2541 |
| 2007/0130733 | A1 * | 6/2007 | Kasai | B29C 66/1248 24/585.12 |
| 2009/0110335 | A1 * | 4/2009 | LeBoeuf | B65D 33/2508 383/42 |
| 2010/0278457 | A1 * | 11/2010 | Greco | B65D 33/2541 383/64 |
| 2013/0016925 | A1 * | 1/2013 | Murray | B65D 75/5883 493/206 |

FOREIGN PATENT DOCUMENTS

| | | | |
|---|---|---|---|
| KR | 20-2015-0003178 | U | 8/2015 |
| KR | 200487661 | Y1 | 10/2018 |
| KR | 200491587 | Y1 | 5/2020 |
| KR | 102186358 | B1 | 12/2020 |

* cited by examiner

SILICONE ZIPPER BAG

CROSS-REFERENCE TO RELATED APPLICATION

The present application is a continuation of International Patent Application No. PCT/KR2022/002433, filed on Feb. 18, 2022, which is based upon and claims the benefit of priority to Korean Patent Application No. 10-2021-0038551 filed on Mar. 25, 2021. The disclosures of the above-listed applications are hereby incorporated by reference herein in their entirety.

BACKGROUND

1. Technical Field

The present disclosure relates to a silicone zipper bag, and more particularly, to an improved silicone zipper bag with excellent sealing properties, comprising a triple sealing structure. Among other things, the present disclosure relates to an improved silicone zipper bag that not only continuously maintains safe and close sealing properties by increasing the effect of suppressing the opening of the central portion according to pressure distribution, by adopting a curved sealing structure, but also fundamentally prevents defects in air bubbles or foreign matter (dirt) from being caught in and tearing an adhered area because two sheets are not laminated together but molded simultaneously to make one piece.

2. Description of Related Art

In general, a zipper bag refers to a multi-purpose storage case provided with a zipper-type coupling portion forming a pair of male and female forms on an open inlet side.

Accordingly, by accommodating various objects inside and locking the coupling portion, it is possible to effectively seal objects inside from the outside.

Such zipper bags are used to store food or liquids requiring freshness or cleanliness, or to store powdered products with very small particles.

In general, a zipper bag is manufactured by folding a sheet made of a synthetic resin, adhering both end surfaces, and forming a zipper in an opening formed after the both end surfaces are adhered.

However, like the coupling structure disclosed in Korean Utility Model Registration No. 20-0491587 (Apr. 24, 2020), most zipper bags have structures in which grooves and protrusions are simply combined. Since the zipper is formed with an in-line shape, that is, a straight line, when pressure is applied to the left and right sides of the zipper bag with the embedded contents, the pressure is concentrated in a central portion of the length of the zipper, and the central portion may open easily or the combined zipper may be easily opened due to poor sealing properties.

Although various attempts have been made to solve this deficiency, an effective alternative has not yet been disclosed because the above-described conventional structure could not deviate from the limitations thereof.

In addition, there is a disadvantage in that the zipper is easily opened and the sealing force is lost even when a small wrinkle occurs, because the remainder of the area, except for the zipper, may crumple easily.

Among other things, the conventional zipper bag is made by laminating two plates, that is, adhering two sheets facing each other along the perimeter, so that there may be a lot of defects in the adhesive process, such as bubble formation, foreign matter (dirt) mixing, and easy tearing or ripping of the adhered area.

SUMMARY

The present disclosure has been devised to obviate the above limitations. An aspect of the present disclosure is directed to providing an improved silicone zipper bag with excellent sealing properties with a triple sealing structure. Among other things, the present disclosure is directed to providing an improved silicone zipper bag that not only continuously maintains safe and close sealing properties by increasing the effect of suppressing the opening of the central portion according to pressure distribution by adopting a curved sealing structure, but also fundamentally prevents defects in air bubbles or foreign matter (dirt) from being caught in and tearing an adhered area, because two sheets are not laminated together but are molded simultaneously to make one piece.

An aspect of the present disclosure is directed to providing a silicone zipper bag including: a first outer cover 100 and a second outer cover 110 integrally formed with each other so that an upper mold molds an object to be molded contained in a cavity of a lower mold simultaneously to have storage space; and a zipper unit 200 integrally formed on an upper end of the first and second outer covers 100 and 110, wherein the zipper unit 200 includes first and second zippers 210 and 220 that are locked or unlocked with each other, and wherein the first and second zippers 210 and 220 have a triple sealing structure.

The zipper unit 200 has the farthest distance L1 from lower ends of the first and second outer covers 100 and 110 to a length central portion of the zipper unit 200, and high-frequency bonding is performed along an example curve C with distances L2 and L3 getting shorter towards both ends.

In addition, the first and second support pieces 230 and 240 are configured to gradually increase in thickness from a lower end to an upper end, thus having a structure for suppressing deformation force making the zipper unit 200 wrinkled in a length direction and releases a zipper lock.

In addition, the first zipper 210 includes a protrusion unit having an upper projection unit Z1, a central locking recessed groove H, and a lower projection unit Z2; and the second zipper 220 includes an upper locking groove H1, a central locking protrusion T, an upper hook HK1 through which a lower locking groove H2 and the upper projection unit Z1 are locked, and a lower hook HK2 through which the lower projection unit Z2 is locked. It is also characterized in that it is formed in a single sealing shape by coupling between the upper projection unit Z1 and the upper locking groove H1, a double sealing shape by coupling between the central locking recessed groove H and the central locking protrusion T, and a triple sealing shape by coupling between the lower projection unit Z2 and the lower locking groove H2.

According to the present disclosure, the following advantages can be obtained.

First, it has a triple sealing structure and has excellent sealing properties.

Second, by adopting a curved sealing structure, it is possible to continuously maintain safe and close sealing properties by increasing the effect of suppressing the opening of the central portion according to pressure distribution.

Third, because two sheets are not laminated together but molded simultaneously to make one piece, there is an effect of fundamentally preventing defects in air bubbles or foreign matter (dirt) from being caught in and tearing an adhered area.

DETAILED DESCRIPTION

Hereinafter, a preferred embodiment according to the present disclosure will be described in more detail with reference to the accompanying drawings.

Prior to the description of the present disclosure, the following specific structural or functional descriptions are only exemplified for the purpose of describing embodiments according to the concept of the present disclosure, and embodiments according to the concept of the present disclosure may be implemented in various forms, but should not be construed as being limited to the embodiments described herein.

As illustrated in FIGS. 1 to 4, the silicone zipper bag according to the present disclosure includes the first outer cover 100 and the second outer cover 110.

However, the division into the first and second outer covers 100 and 110 is for convenience of explanation, and they are all integrally formed, that is, a single barrel.

In other words, the silicone zipper bag according to the present disclosure is not made by laminating two sheets using a method such as adhesion, but by molding the whole from the beginning to store things.

Accordingly, since the silicone zipper bag according to the present disclosure does not have an adhesive line, a defect itself that is torn or ripped along the adhesive line does not occur.

Among other things, since the silicone zipper bag is not adhered, it has the feature of being able to fundamentally prevent defects in air bubbles generated during adhesion and defects occurred when foreign matter (dirt) is mixed therein.

Figure 6:
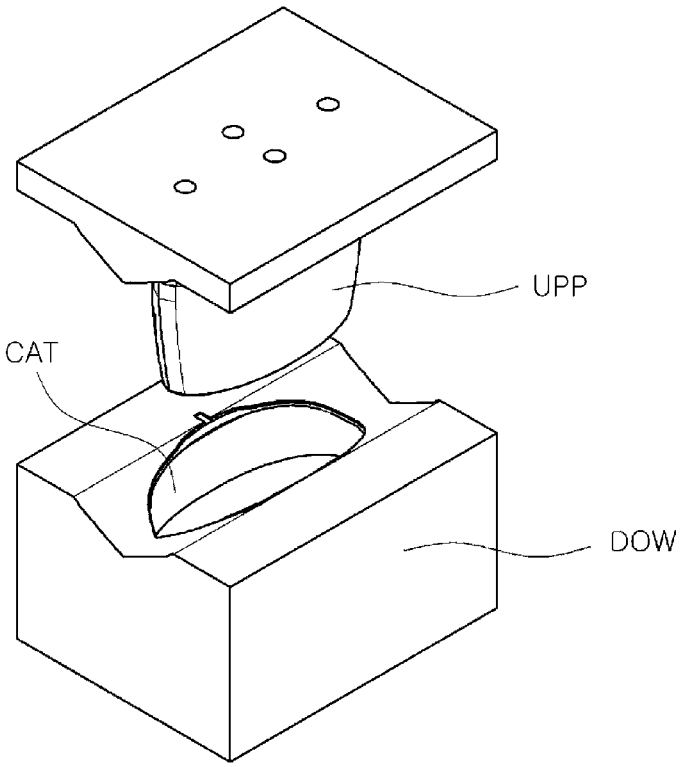
FIG. 6 is an exemplary view of a mold for manufacturing a silicone zipper bag according to the present disclosure.
Figure 7:
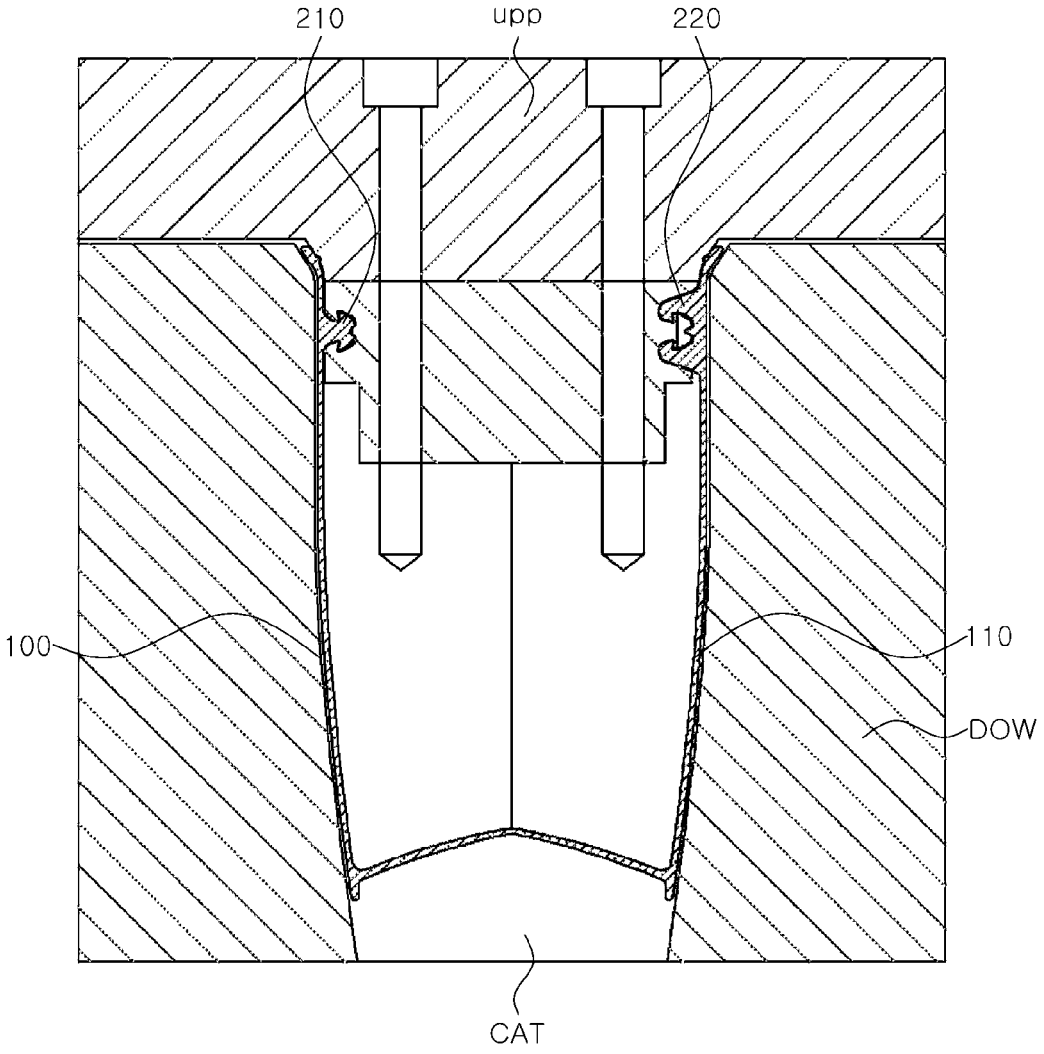
FIG. 7 is an exemplary cross-sectional view illustrating a shape when molding a silicone zipper bag with the mold of FIG. 6.

Such a zipper bag is formed in a molding method simultaneously through a mold as illustrated in FIG. 6, in other words, a lower mold DOW having a zipper bag-shaped cavity CAT and an upper mold UPP that is combined with the cavity (CAT) to create a storage space in the zipper bag, and has a formed cross section as illustrated in FIG. 7.

The first and second outer covers 100 and 110 are formed with silicone to have translucency, so that the stored object stored therein may be viewed from the outside.

In particular, the first and second outer covers 100 and 110 may further contain 20 parts by weight of fluoroalkylsilane based on 100 parts by weight of silicone as the main material. This reduces the contact angle hysteresis and provides excellent separability, thereby reducing the stickiness of a stored object and contributing to easy loading and unloading of the stored object.

The zipper unit 200 is also integrally formed on the upper ends of the first and second outer covers 100 and 110.

Figure 1:
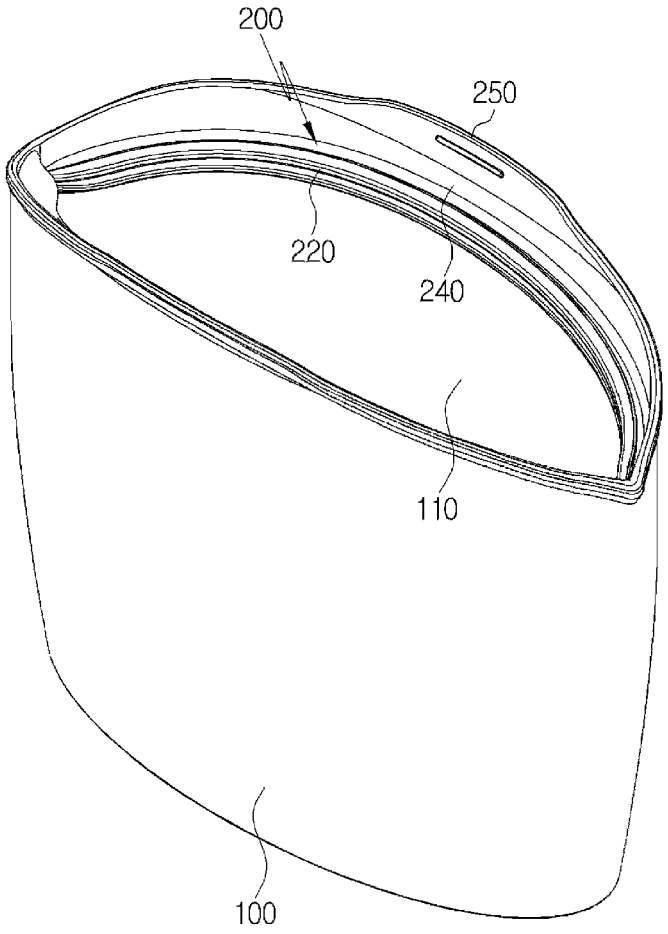
FIG. 1 is an exemplary perspective view of a silicone zipper bag according to the present disclosure.
Figure 2:
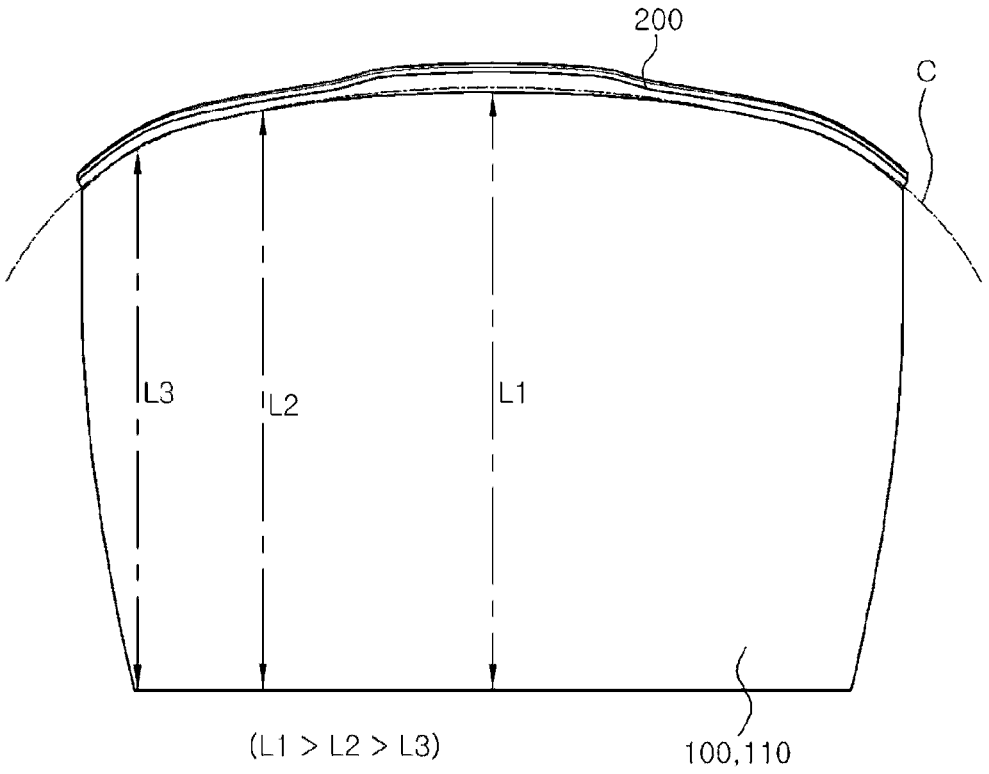
FIG. 2 is an exemplary front view of FIG. 1.
Figure 3:
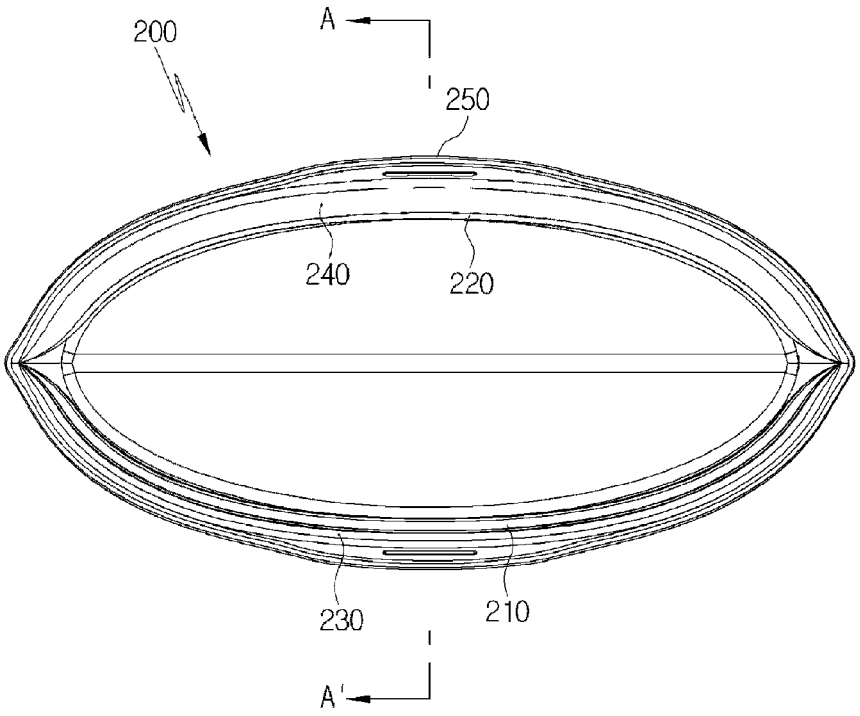
FIG. 3 is a plan view illustrating a state in which the entrance of the zipper bag of FIG. 1 is opened.

As shown in the example of FIG. 2, the zipper unit 200 is formed while forming a constant curvature on the upper ends of the first and second outer covers 100 and 110, and this is one of the characteristics that is markedly different from the existing zipper bag.

For example, the conventional zipper bag is differentiated in that a zipper unit is bonded horizontally and in a straight line to an upper end of the outside, whereas the zipper unit of the present disclosure is formed along the example curve C of FIG. 2.

The reason for forming the zipper unit 200 along a certain curvature as shown in the example curve (C) is to suppress the central zipper opening phenomenon by having a certain curvature to distribute pressure and, as a result, to reduce pressure concentration because when an external force is applied to the first and second outer covers 100 and 110 in a state in which a stored object is stored, due to the characteristics of the zipper bag, as the pressure is concentrated in the length central portion of the zipper unit 200, the zipper of the central portion usually bursts (opens) and the sealing state is released.

In other words, based on the example curve C, the length central portion of the zipper unit 200 has the farthest distance L1 from lower ends of the first and second outer covers 100 and 110, and the distances L2 and L3 thereof are shorter towards both ends. Hence, when an external force pressing the first and second outer covers 100 and 110 occurs and when the external force reaches the central portion, since the result that has already been reached in turn from both ends is achieved, the pressure is evenly distributed over the entire zipper unit 200, so that it is concentrated in one place, thereby suppressing the phenomenon of easily opening there.

Accordingly, it has the advantage of maintaining high sealing force for a long time by resolving the deficiency that the zipper is easily opened locally.

In addition, the zipper unit 200 includes first and second zippers 210 and 220 that are locked or unlocked with each other, first and second support pieces 230 and 240 extending from the first and second zippers 210 and 220, and a handle 250 extending from a center in a length direction of either or both of the first and second support pieces 230 and 240.

Figure 4:
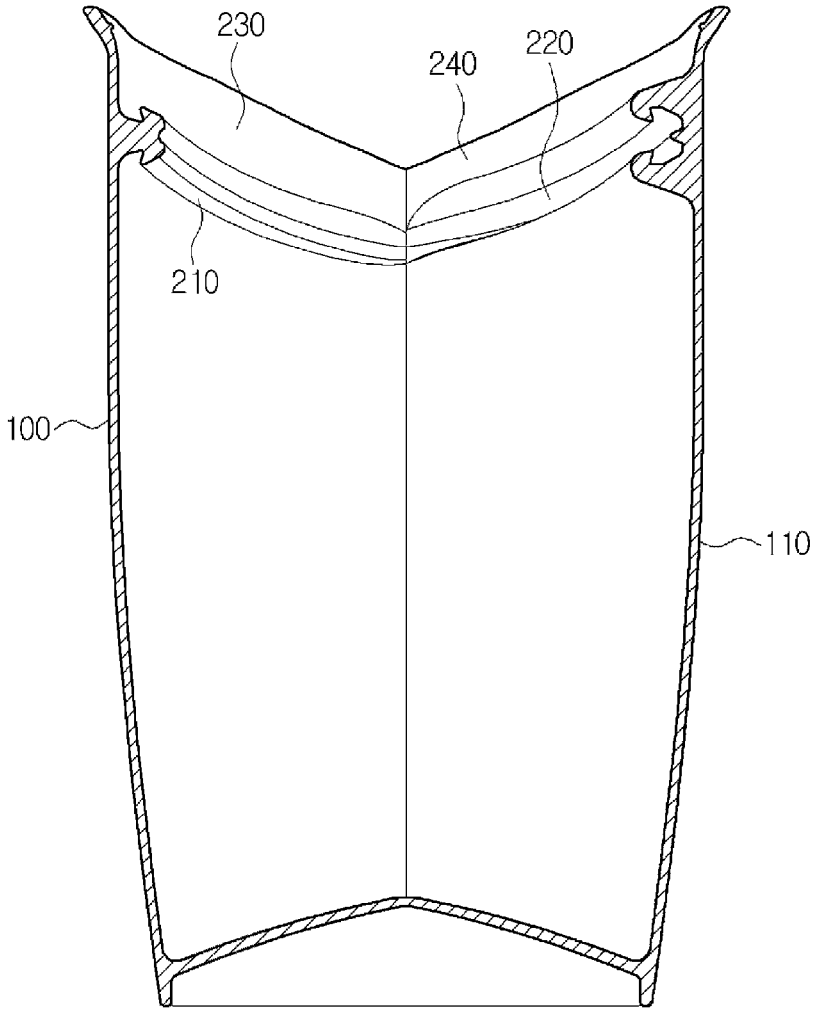
FIG. 4 is an exemplary cross-sectional view illustrating a state in which the entrance of the zipper bag of FIG. 1 is opened in a longitudinal direction.
Figure 5A:
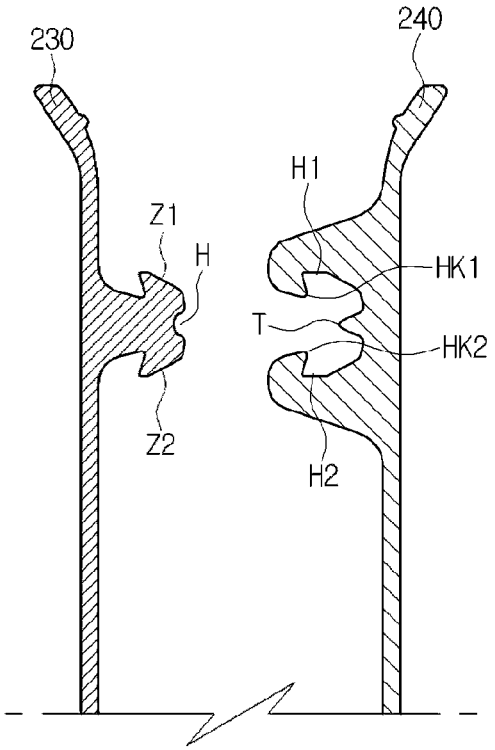
FIG. 5A is an enlarged exemplary view illustrating a state in which the first zipper and the second zipper of the silicone zipper bag according to the present disclosure are separated.
Figure 5B:
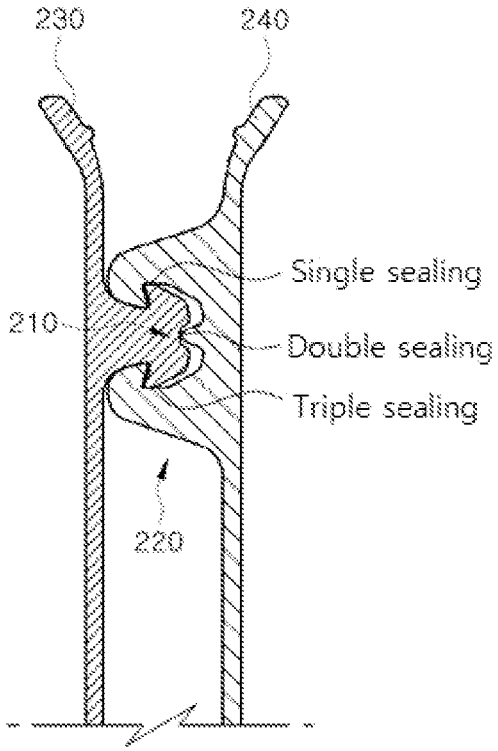
FIG. 5B is an enlarged exemplary view illustrating a state in which the first zipper and the second zipper of the silicone zipper bag according to the present disclosure are combined.

As in the examples of FIGS. 4 and 5, in the case of the first and second support pieces 230 and 240, by providing a step in thickness, the tension is always maintained so as not to crumple in a length direction, and thereby, it is configured to obtain the effect of preventing the zipper lock from being released in advance, which is also one of the important features of the present disclosure.

In other words, when the thicknesses of the first and second support pieces 230 and 240 are the same as before, the tension in a longitudinal direction is not maintained well, and thus, there is a disadvantage of becoming wrinkled. Then, as it becomes wrinkled, deformation force is generated, which affects the zipper lock, causing the zipper lock to open easily.

However, the present disclosure is configured to prevent such a deficiency in advance. In particular, it is preferable that the thickness variable gradually increases from the lower end to the upper end of the first and second support pieces 230 and 240.

In addition, the width of the first and second support pieces 230 and 240, that is, the distance from the first and second zippers 210 and 220 to the upper end, is configured to be slightly different (the width of the central portion is larger) in order to prevent this deformation force more forcibly, it is possible to prevent crumpling in a length direction more effectively.

In addition, the first zipper 210 is formed as a protrusion unit, and the second zipper 220 has a groove unit and is formed to project to have a mutually combining structure.

The first zipper 210 is preferably formed on an upper end of the first outer cover 100, and the second zipper 220 is preferably formed in a position corresponding to the first zipper 210 on an upper end of the second outer cover 110.

Among other things, another feature is that the first and second zippers 210 and 220 are implemented to innovatively increase the sealing force, as compared to the existing ones by having a triple sealing structure when combined with each other.

To this end, the first zipper 210 has a strip shape projecting to a predetermined height along the opening direction of the zipper bag from an inner wall of the first outer cover 100 toward an inner wall of the second outer cover 110.

The second zipper 220 corresponds to the first zipper 210, and has a strip shape projected in a length direction of the zipper bag from an inner wall of the second outer cover 110 toward an inner wall of the first outer cover 100, that is, at a certain height along the opening direction of the zipper bag. Accordingly, the first zipper 210 is combined with the second zipper 220 to lock the zipper bag, or is separated from the second zipper 220 to unlock the zipper bag.

The first zipper 210 has the central locking recessed groove H recessed to a predetermined depth along the first zipper 210 in the center of the upper projection unit of the first zipper 210, an upper projection unit Z1 obliquely projecting toward an inner wall of the first outer cover 100 along an upper edge of the central locking recessed groove H toward the top of the zipper bag, and the lower projection unit Z2 obliquely projecting toward an inner wall of the first outer cover 100 along a lower edge of the central locking recessed groove H toward the bottom of the zipper bag. Accordingly, the first zipper 210 has a protrusion unit in which an 'M'-shaped cross-sectional shape is rotated clockwise by 90°.

In addition, the second zipper 220 includes a central locking protrusion T that is combined with and coupled to the central locking recessed groove H of the first zipper 210 so as not to be easily opened by being caught in after the first zipper 210 is inserted, an upper locking groove H1 that is combined with and coupled to the upper projection unit Z1 of the first zipper 210, a lower locking groove H2 that is combined with and coupled to the lower projection unit Z2 of the first zipper 210, an upper hook HK1 through which the upper projection unit Z1 is caught and is not easily separated, and a lower hook HK2 through which the lower projection unit Z2 is caught and is not easily separated.

Thereby, the silicone zipper bag has a structure of a single sealing by coupling between the upper projection unit Z1 and the upper locking groove H1, a double sealing by coupling between the central locking recessed groove H and the central locking protrusion T, and a triple sealing by coupling between the lower projection unit Z2 and the lower locking groove H2.

As such, the present disclosure provides measures for at least 3 close sealing in which the zipper unit is configured to be curved, the thickness or width of the support surface is different to prevent wrinkling deformation in a length direction, and the zipper lock has a triple locking sealing structure. When at least one thereof is provided, the sealing effect is significantly improved. When all three are provided, the sealing property is expected to be three times higher than that of an existing zipper bag.

The invention claimed is:

1. A silicone zipper bag including:

a first outer cover and a second outer cover integrally formed with each other so that an upper mold molds an object to be molded contained in a cavity of a lower mold simultaneously to have a storage space; and a zipper unit integrally formed on an upper end of the first and second outer covers, wherein:

the zipper unit includes first and second zippers that are locked or unlocked with each other, first and second support pieces extending from the first and second zippers, and a handle extending from a center of a length of either or both of the first and second support pieces;

the zipper unit has the farthest distance from lower ends of the first and second outer covers to a length central portion of the zipper unit, and high-frequency bonding is performed along an example curve with distances getting shorter towards both ends;

the first and second support pieces are configured to gradually increase in thickness from a lower end to an upper end, thus having a structure for suppressing deformation force making the zipper unit wrinkled in a length direction and releases a zipper lock; and the first and second outer covers are formed from a composition containing silicone and 20 parts by weight of fluoroalkylsilane based on 100 parts by weight of the silicone, wherein:

the first outer cover has a first upper area, a first middle area positioned below the first upper area, and a first lower area positioned below the first middle area;

the first zipper is placed on the first middle area;

the first upper area configures the first support piece, has gradually increasing thickness from a lower end to an upper end of the first upper area, and has a first protruding step;

a width of a central portion of the first upper area, that is the distance from the first middle area to an upper end of the first upper area, is greater than widths of left and right ends of the first upper area;

the second outer cover has a second upper area, a second middle area positioned below the second upper area, and a second lower area positioned below the second middle area;

the second zipper is placed on the second middle area;

the second upper area configures the second support piece, has gradually increasing thickness from a lower end to an upper end of the second upper area, and has a second protruding step; and a width of a central portion of the second upper area, that is the distance from the second middle area to an upper end of the second upper area, is greater than widths of left and right ends of the second upper area.

2. The silicone zipper bag of claim 1, wherein:

the first zipper includes a protrusion unit having an upper projection unit, a central locking recessed groove, and a lower projection unit;

the second zipper includes an upper locking groove, a central locking protrusion, an upper hook through which a lower locking groove and the upper projection unit are locked, and a lower hook through which the lower projection unit is locked; and the silicone zipper bag is formed in a single sealing shape by coupling between the upper projection unit and the upper locking groove, a double sealing shape by coupling between the central locking recessed groove and the central locking protrusion, and a triple sealing shape by coupling between the lower projection unit and the lower locking groove.

* * * * *